United States Patent [19]

Dubuit

[11] Patent Number: 4,574,694

[45] Date of Patent: Mar. 11, 1986

[54] STAMPING MACHINES WITH COORDINATED MOVEMENT OF OPPOSING DIES

[75] Inventor: Jean-Louis Dubuit, Paris, France

[73] Assignee: Societe d'Esploitation des Machines Dubuit, Paris, France

[21] Appl. No.: 655,463

[22] Filed: Sep. 28, 1984

[30] Foreign Application Priority Data

Sep. 29, 1983 [FR] France ..... 83 15548

[51] Int. Cl.[4] ..... B44C 1/14; B41F 17/24

[52] U.S. Cl. ..... 101/11; 101/44; 101/316; 198/343; 198/859

[58] Field of Search ..... 101/9–11, 101/27, 316, 318, 38 R, 38 A, 41, 44; 198/343, 345, 859

[56] References Cited

U.S. PATENT DOCUMENTS

| | | | |
|---|---|---|---|
| 289,480 | 12/1883 | White | 101/9 |
| 1,079,313 | 11/1913 | Colby et al. | 101/9 |
| 1,973,196 | 9/1934 | Baker | 198/859 X |
| 2,551,080 | 5/1951 | Allen et al. | 198/343 |
| 2,751,841 | 6/1956 | Grupe | 101/11 X |
| 3,195,450 | 7/1965 | Sciame | 101/9 |
| 3,229,401 | 1/1966 | Sobran | 101/9 X |
| 3,382,795 | 5/1968 | Downs | 101/9 |
| 3,478,680 | 11/1969 | Anderson | 181/32 |
| 3,490,363 | 1/1970 | Derrickson | 101/38 R |
| 3,608,480 | 9/1971 | Sciame | 101/11 X |
| 3,732,807 | 5/1973 | Robertson | 101/11 |

FOREIGN PATENT DOCUMENTS 1093042 4/1955 France .

*Primary Examiner*—Clifford D. Crowder

*Attorney, Agent, or Firm*—Charles E. Brown; Charles A. Brown

[57] ABSTRACT

A stamping machine comprises at least one imprinting station of the gilding press type, wherein two shells mounted movably relative to one another are intended to mutually enclose at least the portion to be imprinted of the article to be imprinted, so as to apply to this latter a foil suitable for the impression desired. Both the shells are mounted movably relative to the machine frame in synchronism and opposed to one another, said shells being subject to the same control means which acts on one of them by way of transmission means suitable for reversal of movement. The machine is particularly applicable to the imprinting of articles with a neck, such as bottles.

15 Claims, 9 Drawing Figures

STAMPING MACHINES WITH COORDINATED MOVEMENT OF OPPOSING DIES

BACKGROUND OF THE INVENTION

1. Field of the Invention

The present invention relates generally to stamping machines comprising at least one imprinting station of the gilding press type.

2. Prior Art

It is known that at such an imprinting station a stamp or die, which is mounted suitably movable for this purpose and the pattern of which corresponds to that of the desired impression, applies to the article to be imprinted a foil or leaf suitable for this type of impression.

The present invention relates more particularly, but not necessarily exclusively, to the case in which the articles to be imprinted are articles with a neck, for example bottles, which being made of synthetic material and thus not having per se sufficient rigidity to provide in satisfactory manner a suitable support for the stamp thereby make it necessary for their internal volume to be placed under pressure when they are being imprinted, so as to provide an abutment for said stamp.

It is thus necessary to use at the imprinting station in question two shells which, mounted movably relative to one another, are designed to mutually enclose at least the portion to be imprinted of the bottle to be imprinted and, in practice, almost the whole bottle, so as to counteract its internal pressure while it is being imprinted.

In practice, in the hitherto known machines of the type in question only one of the shells is movable and, usually, since said shells are arranged vertically on either side of the article to be imprinted, this would be the upper shell, the lower shell being firmly secured to the frame of such a machine.

This arrangement gives rise to various disadvantages.

Firstly, it is the machine frame which receives the reaction force to which the movable shell is subjected during imprinting of the article to be imprinted and, therefore, this frame has to be strengthened, to the detriment of its weight and cost.

Moreover, since the lower shell is fixed and the conveyor carrying the article-carrier supports necessarily extends at a distance therefrom, it is necessary to provide transfer means for each article to be imprinted from the article-carrier support which carries it to said lower shell, before it is imprinted, and from this lower shell to said article-carrier support after imprinting, to the detriment of the operating rhythm of the machine and its simplicity.

In French Patent No. 1,093,042, and likewise in U.S. Pat. No. 3,478,680, it is proposed to use two shells both movably mounted and thus suitable for enclosing the article to be imprinted.

However, their control means are independent, which can result in synchronization problems.

The present invention relates generally to a device which enables these disadvantages to be obviated and which, moreover, achieves further advantages.

SUMMARY

More specifically, the invention relates to a stamping machine of the type comprising at least one imprinting station of the gilding press type, wherein two shells both mounted movably relative to the machine frame in opposite directions, in relation to one another, are designed to mutually enclose at least the portion to be imprinted of the article to be imprinted, so as to apply to this latter a foil suitable for the desired impression, this machine being generally characterized in that said shells are both subject to the same control means, said means acting on one of them by way of transmission means suitable for reversal of movement.

In practice, said shells are both mounted for translational movement, e.g. by both being coupled to the piston rod of a double-acting actuator, the body of which is connected to the machine frame and the rod of which acts on one of the shells via the transmission means suitable for reversal of movement, used in accordance with the invention.

Whatever the circumstances, as a result of this transmission means the shells are perfectly synchronized.

Furthermore, when they are closed on the article to be imprinted, there occurs automatically a systematic balancing between the forces of action and reaction to which they are mutually subjected, thereby relieving the frame accordingly.

Moreover, since the machine according to the invention is of the type in which a conveyor carrying at least one article-carrier support designed to support an article to be imprinted ensures that such an article-carrier support passes the imprinting station at right angles thereto, the arrangement according to the invention advantageously makes it possible to reconcile a passing movement in a plane of this article-carrier support with the retention thereon of the article to be imprinted, without any transfer of this article between such an article-carrier support and the lower shell provided for its support during imprinting.

In addition to thus avoiding any transfer, the operating rhythm of the machine is improved; therefore, the arrangement according to the invention is advantageously suited to an in-line arrangement of a plurality of imprinting stations along the conveyor, it being possible for said imprinting stations to be further gilding-type presses or imprinting stations of another type, for example silk screen printing stations.

When the imprinting of an article with a neck is involved, such as a bottle, the article-carrier support carried by the conveyor may comprise, for example, a core on which such a bottle can be engaged by its neck.

However, for the reasons outlined above, it is then necessary to provide an abutment for the bottom of this bottle while it is being imprinted, in addition to that for its neck.

For this purpose, it is possible to consider suitably shaping the two movable shells used at the imprinting station.

However, engaging them over the bottle to be imprinted is not readily carried out if such a bottle is not properly centered in suitable manner relative to the article-carrier support carrying it.

A centering operation of this type is already difficult to carry out reliably, since the bottle extends overhung in relation to the core, on which it is engaged, from this article-carrier support.

In order to overcome this problem it is proposed to use at the imprinting station, at right angles to the article-carrier support, a support block which, mounted to move transversely in relation to the conveyor, is designed to be applied against the bottom of the bottle to be imprinted and, according to the invention, the stamping machine thus equipped is also characterized in that the support block is surrounded by a centering sleeve mounted so as to be axially retractable between an extended position, in which it projects beyond said support block, and a retracted position, in which at most it is level with this latter.

There are thus satisfied in very simple manner the two apparently contradictory requirements of suitable centering of the bottle to be imprinted before it is enclosed by the two shells used for this purpose, on the one hand, and of an effective abutment for the bottom of this bottle while it is being imprinted, on the other hand.

In fact, the prior centering of the bottle is ensured by the centering sleeve according to the invention and the latter is withdrawn before the movable shells are closed on to this bottle, thereby allowing this closing to be carried out effectively without interfering with this centering sleeve, only the support block then ensuring the necessary abutment.

Furthermore, in the case of an imprinting station of the gilding press type, the conveyor does of course advance step by step at right angles to such an imprinting station, so as to be halted at this station for the time necessary to close the movable shells and to effect the desired impression.

However, according to a development of the invention, an arrangement is provided also enabling this conveyor to have at least one section along which it advances continuously.

According to this arrangement, the stamping machine of the invention, which is thus of the type in which a conveyor, passing in an endless loop over a plurality of guide members, at least one of which imparts drive, and carrying at least one article-carrier support designed to support an article to be imprinted, ensures that said article-carrier support passes the imprinting station, is characterized in that, along a first section, which serves the imprinting station, said conveyor is advanced step by step, whereas, along a second section, which is controlled by the driving guide member, it is advanced continuously with, between said sections, two guide members both carried by a common slide, which forms compensating means, mounted for reciprocating movement on the machine frame, under the control of control means in synchronism with said driving guide member.

Advantageously, it is thus possible to ensure a continuous and thus simple control of the driving guide member and/or to serve with a continuously advancing conveyor section one or more imprinting stations, other than gilding-type presses.

Preferably, the slide carrying two guide members, which forms a compensating means, is coupled to its control means, e.g. a simple rotating cam, via a shock-absorbing block.

Therefore, at the imprinting station, resilient play is advantageously possible between the article-carrier support carried by the conveyor, on the one hand, and the movable shells, on the other hand, thereby enabling this article-carrier support to be suitably centered relative to said movable shells, despite the fact that it is carried by the conveyor.

For this purpose and in accordance with the invention, one of the movable shells is preferably securely connected with a centering fork which is designed to be engaged over a part of the article-carrier support and which systematically ensures suitable positioning of this latter relative to the movable shells.

DESCRIPTION OF THE PREFERRED EMBODIMENT

Figure 4:
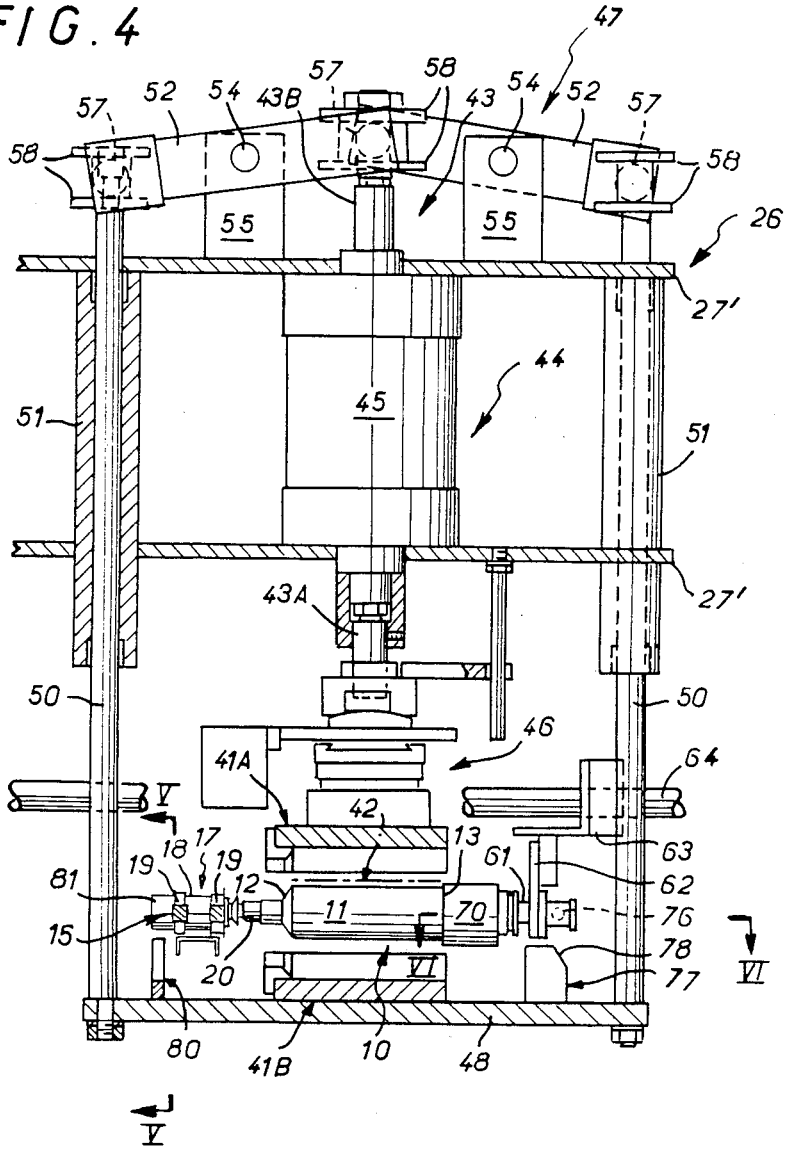
FIG. 4, again on a different scale, is a partial view in cross-section, taken along the line IV—IV in FIG. 1, of an imprinting station of the gilding press type provided in the machine according to the invention, showing the opening disposition of the movable shells provided at this imprinting station.
Figure 5:
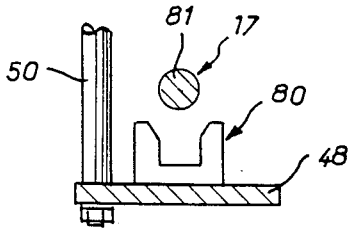
FIG. 5 is a partial cross-sectional view of this imprinting station, taken along the line V—V in FIG. 4.

These drawings show, by way of example, the application of the invention to the handling of bottles 10, one of which is visible in FIG. 4.

A bottle 10 of this type, which is made of synthetic material, comprises in per se known manner a body 11, to which an impression is to be applied, a neck or collar 12 and a bottom 13.

In the form of embodiment illustrated, the stamping machine used for handling these bottles 10 comprises a conveyor 15 which passes in an endless loop over a plurality of guide members 16, at least one of which imparts drive, and which carries from place to place and at regular intervals a plurality of article-carrier supports 17, each designed to support one such bottle 10.

In practice, in this form of embodiment, each of these article-carrier supports 17 is of the type described in French Patent Application No. 82 09549 filed on 2nd June 1982.

An article-carrier support 17 of this type, one of which is shown in FIG. 4, will thus not be described in full here.

It is sufficient to indicate that it comprises a body 18, which is connected by lugs 19 to the links of a double chain forming the conveyor 15, and a core 20 projecting relative to this body 18, mounted to move axially relative thereto and forming a blast nozzle, on which core a bottle 10 can be engaged by its neck 12.

In any case, along an upper horizontal section 21, the conveyor 15 ensures that the various article-carrier supports 17 carried by it pass at right angles to at least one imprinting station 22.

In practice, in this form of embodiment, three imprinting stations 22 are thus provided successively, spaced apart along this upper horizontal section 21 of the conveyor 15.

If, as will become apparent below, imprinting stations of the gilding press type are involved, the conveyor 15 has to advance step by step along at least the section 21, thereby ensuring that they are served.

However, according to one aspect of the invention it advances continuously along a second section which, for example, may be the lower return section 24 and which, in any case, is the one controlled by its driving guide member.

To ensure the connection between the section 21 advancing step by step and the continuously advancing section 24, with which the conveyor 15 is thus provided, two guide members 16 of this conveyor 15 situated between the two sections 21, 24 in question are both carried by a common slide 25 which, forming compensating means, is mounted for reciprocating movement on the machine frame 26, under the control of control means in synchronism with the associated driving guide member.

Here the expression 'lower return section 24' means, for the conveyor 15, the whole of that part of this conveyor which, in relation to its upper horizontal section 21, is situated on the other side of the guide members 16 thus carried by a slide 25 and any of the guide members 16 provided on this latter may constitute the driving guide member thereof.

Depending on the person skilled in the art, the frame 26 will not be described.

Moreover, only some parts of it are indicated at various places in the drawings and all bear the same reference numeral 26.

Figure 1:
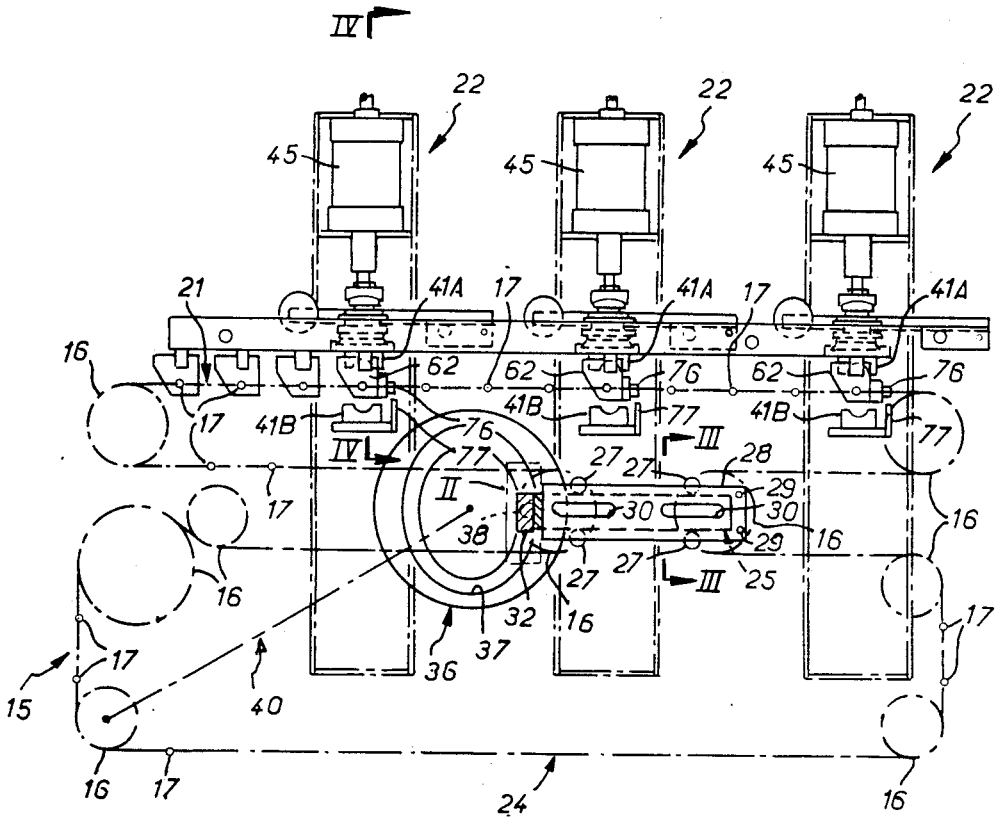
FIG. 1 is a partial view in elevation of an imprinting machine according to the invention, with a locally sectioned portion.
Figure 3:
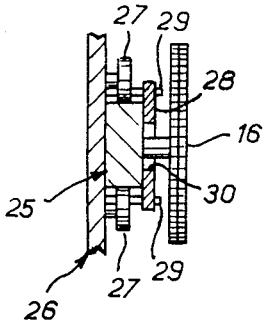
FIG. 3, on a different scale, is a partial view in cross-section of the machine according to the invention, taken along the line III—III in FIG. 1.

As indicated schematically in FIG. 1 and as shown more clearly in FIG. 3, the slide 25 forming compensating means is engaged to slide between rollers 27 mounted to rotate on the frame 26, by being disposed between an element of the frame and a retaining plate 28 secured thereon by pins 29.

The retaining plate 28 is provided longitudinally with a slot 30, through which passes the pivot of each of the guide members 16 carried thereby.

Figure 2:
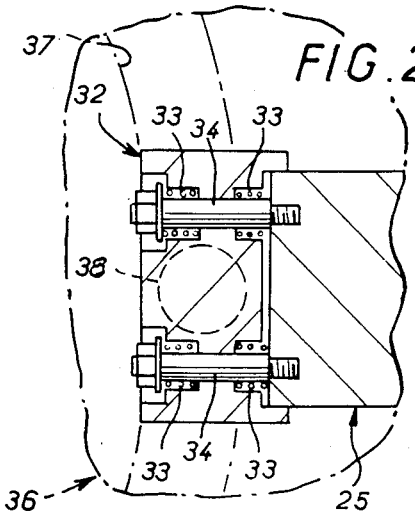
FIG. 2 shows on an enlarged scale the detail in FIG. 1, which is denoted by an inset II in this FIG. 1 and concerns the locally sectioned portion shown therein.

In the form of embodiment illustrated and for reasons to be explained subsequently, the slide 25 forming compensating means is connected with its control means by way of a shock-absorbing block 32, shown more clearly in FIG. 2. In practice, this shock-absorbing block 32 is engaged to slide, in opposition to return springs 33 with respect to which it is mounted to float, on stay rods 34 carried longitudinally by the slide 25 and projecting for this purpose over its transverse edge at the corresponding end.

Furthermore, in the form of embodiment illustrated, the control means, which acts on the slide 25 forming compensating means, is a cam 36 mounted to rotate on the machine frame 26.

In practice, this cam 36 comprises a track 37 which is engaged by a roller 38 mounted to rotate on tne shock-absorbing block 32 associated with the slide 25 forming compensating means.

As indicated by a chain line 40 in FIG. 1, the cam 36 is mounted to rotate, possibly by way of any suitable transmission means, with one of the guide sprockets 16 of the conveyor 15, assumed here to be its driving guide member.

In practice, since the conveyor 15 comprises a double chain, as indicated above, all its guide members 16 are double-toothed sprockets mounted to rotate on the machine frame 26; for simplification of FIG. 1, they are merely indicated therein by their outline in chain lines.

At each of the imprinting stations 22 there are provided two shell-shaped platens 41A,41B, each respectively arranged on either side of the upper horizontal section 21 of the conveyor 15, which are mounted movably relative to one another and together are designed to enclose the part to be imprinted, in this case at least the body 11 of bottles 10, so as to apply thereto a foil or leaf 42 suitable for the impression desired.

According to the invention, both of these shells 41A,41B are mounted movably relative to the machine frame 26 in opposite directions in relation to one another, and they are both acted on by common control means, said control means acting on one of them via transmission means suitable for reversal of movement.

In the embodiment illustrated, the shells 41A,41B are both mounted for translational movement on the frame 26.

In practice, in this form of embodiment, the control means common to them is a double-acting actuator 44 and they are both coupled to the piston rod 43 of this double-acting actuator 44, whereas the body 45 of this latter is connected to the machine frame 26, for example by being clamped at its ends between two plates 27' of this frame 26.

The actuator 44 extends vertically above the conveyor 15 and its piston rod 43 projects beyond its body 43 at both ends thereof.

With its lower end 43A the piston rod 43 acts on the shell 41A, the latter being the upper shell in relation to the bottle 10 to be imprinted.

In practice and in accordance with methods known per se, which are not dependent on the present invention and which will thus not be described in detail here, it thus acts on this shell 41A via means 46 designed to enable the position thereof to be adjusted.

With its upper end 43B, by way of transmissicn means 47 suitable for reversal of movement, the piston rod 43 acts on the shell 41B, the latter being the lower shell in relation to the bottle 10 to be imprinted.

In the form of embodiment illustrated, the transmission means 47 suitable for reversal of movement comprises two arms 52 which, in their central zone, are both mounted to pivot on the frame 26 and are both pivotally connected, on the one hand, to the relevant end 43B of the piston rod 43 at the same level thereof and, on the other hand, in each case to two respective supporting columns 50 carrying the shell 41B.

In practice, this lower shell 41b is carried by a plate 48, of rectangular shape, at two opposite corners of which there are secured, in each case by one of their respective ends, two supporting columns 50 and these latter are each fitted to slide in respective sleeves 51 fastened to the frame 26.

In the form of embodiment illustrated, the arms 52, each arranged respectively on either side of the piston rod 43, are each individually articulated by a pivot 54 to a flange 55 secured to the frame 26, in their central zone, and they carry at each of their ends a roller 57 engaged between two rings 58 secured to the corresponding supporting column 50, for one of said ends, and to the relevant end 43B of the piston rod 43, for the other of said ends.

In practice, it is the upper shell 41A which carries the stamp corresponding to the impression to be effected and, therefore, it is on this side that the corresponding imprinting foil 42 is provided.

Each of the shells 41A,41B is generally trough-shaped, the cross-section of which is an image of half the cross-section of the body 11 of the bottle 10 to be imprinted, said shells 41A,41B being intended to mutually enclose such a bottle 10, along a joint surface forming substantially a plane of symmetry therefor.

However, at one of their ends, corresponding to the neck 12 of the bottle 10, the two shells 41A,41B are cradle-shaped, forming together an image of such a neck 12.

At their other end, however, corresponding to the bottom 13 of the bottle 10, they are fully open in section.

At each imprinting station 22 there is likewise provided, mounted to move transversely relative to the conveyor 15, a support block 60 (FIGS. 6, 7) designed to be applied against the bottom 13 of the bottle 10 while it is being imprinted.

Figure 6:
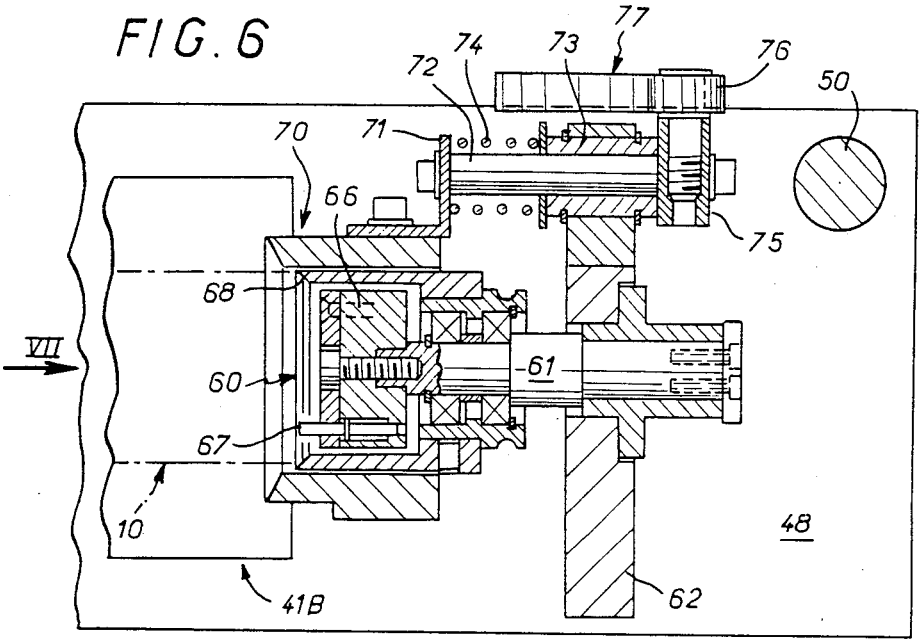
FIG. 6, on a different scale, is another partial view in section, taken along the line VI—VI in FIG. 4.
Figure 7:
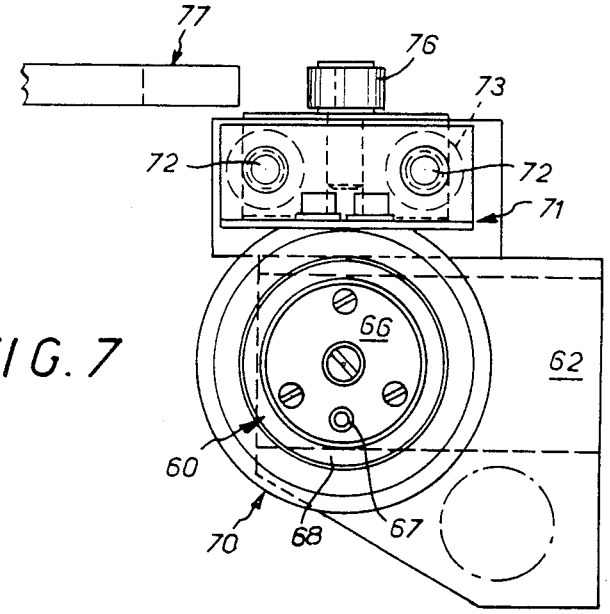
FIG. 7 is a partial view in elevation, in accordance with arrow VII in FIG. 6.

In practice, such a support block 60 is carried by a shaft 61 itself carried by a flange 62 firmly secured to a cross member 63 mounted to slide on guides 64 provided, substantially transversely to the conveyor 15, on the machine frame 26 (FIGS. 4 and 6).

In per se known manner, this support block 60 forming a false bottom comprises, on the one hand, a central hub 66 which is keyed on the support shaft 61 and which carries, for cooperation with a notch normally provided for this purpose on the bottom 13 of the bottle 10 to be handled, a stud 67 mounted to retract elastically and, on the other hand, a bush 68 mounted to rotate about the hub 66, which bush is designed to bear on the periphery of such a bottom 13 and can be driven in rotating motion under the control of a driving device which does not form part of the present invention and, depending on the person skilled in the art, will not be described here.

In practice the arrangement is such that, in plan, the leading edge of the support block 60 thus present, which is formed by the free end of the rotating bush 68 provided thereon, is substantially level with the corresponding transverse edge at the end of the associated shells 41A, 41B.

According to one aspect of the invention, the support block 60 is surrounded by a centering sleeve 70, the leading edge of which is generally frustoconical, having a section which tapers towards the axis of the unit, and which is mounted so as to be axially retractable between an extended position (FIG. 6), in which it projects beyond this support block 60, and a retracted position, in which (FIG. 9) at most it is level with this latter.

In practice, in the form of embodiment illustrated, the centering sleeve 70 is carried by an angle bracket 71 itself supported by two rods 72 which are each engaged respectively to slide in sleeves 73 firmly secured to the support flange 62, in opposition to return springs 74 constantly urging this centering sleeve 70 towards its extended position, and which together carry at their other end a cross member 75 by way of which they are firmly secured to a roller 76 designed to cooperate with a cam 77 firmly secured to the lower shell 41B.

In practice, this cam 77 is formed by a flange secured, preferably so as to be adjustable in position, to the plate 48 carrying the lower shell 41B and to cooperate with the roller 76 it has an inclined face 78.

Finally, one of the shells 41A,41B, in practice this would be the lower shell 41B, is securely connected with a centering fork 80 which is designed to be engaged over a part 81 of each of the article-carrier supports 17.

In the form of embodiment illustrated, this centering fork 80 is carried by the plate 48 carrying the lower shell 41B, and the part 81 of the article-carrier supports 17 with which it is intended to cooperate simply forms an extension of body 18 thereof.

Furthermore, in accordance with arrangements which, depending merely on the person skilled in the art, will not be described here, the double-acting actuator 44 of each imprinting station 22 is controlled in synchronism with the conveyor 15.

As indicated above, and because of the action of the slide 25 forming compensating means which alternately takes up the "slack" at each of its ends, the upper horizontal section 21 of the conveyor 15 serving the imprinting stations 22 advances step by step at right angles to these latter, even though the control of the conveyor 15 is in fact carried out continuously.

In other words, the article-carrier supports 17 carried by this conveyor 15 each halt in turn for a certain amount of time at right angles to each of the imprinting stations 22.

Of course, the advance of the conveyor 15 between such stops takes place when the shells 41A,41B are in the open position (FIG. 4).

The halting of an article-carrier support 17 at right angles to an imprinting station 22 is firstly utilised to apply, to the bottom 13 of the bottle 10 carried by this article-carrier support 17, the support block 60 provided for this purpose at such an imprinting station 22.

This application is facilitated, in practice, by the centering sleeve 70 according to the invention, which is then in an extended position and which, by means of the frustoconical surface of its leading edge, automatically directs towards the bush 68 of this support block 60 the bottom 13 of the relevant bottle 10, even if this latter is initially not located very accurately on the axis of the article-carrier support 17 carrying it.

In per se known manner, the support block 60 then ensures, by means of its bush 68, the rotation about itself of the relevant bottle 10 until the latter stops in a given angular orientation corresponding to the location of the imprint to be made, under the control of its elastically retractable stud 67.

The halting of the article-carrier support 17 at imprinting station 22 is then utilised to close the shells 41A,41B, under the control of the double-acting actuator 44.

Figure 8:
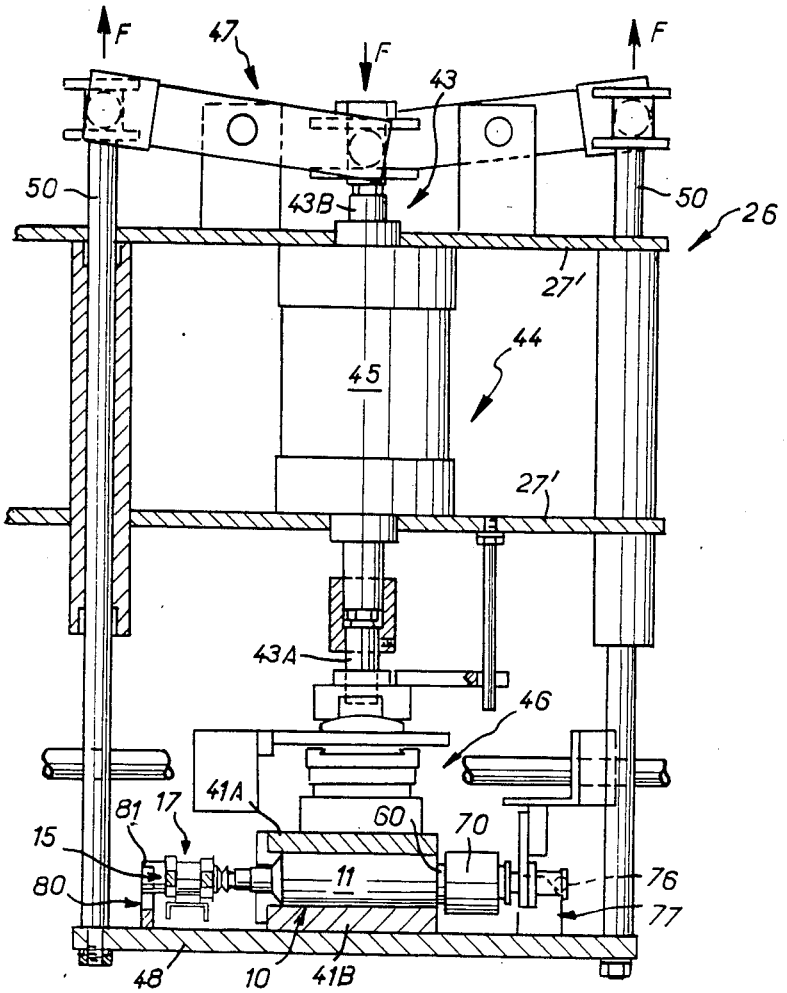
FIGS. 8 and 9 are views similar to those of FIGS. 4 and 6 respectively, showing the closing disposition of the movable shells provided at the imprinting station in question.

The upper shell 41A is then moved downwards, thereby enclosing between itself and the body 11 of the relevant bottle 10 the imprinting foil 42, while at the same time and in synchronism the lower shell 41B is moved upwards, in accordance with the arrows designated F in FIG. 8.

Figure 9:
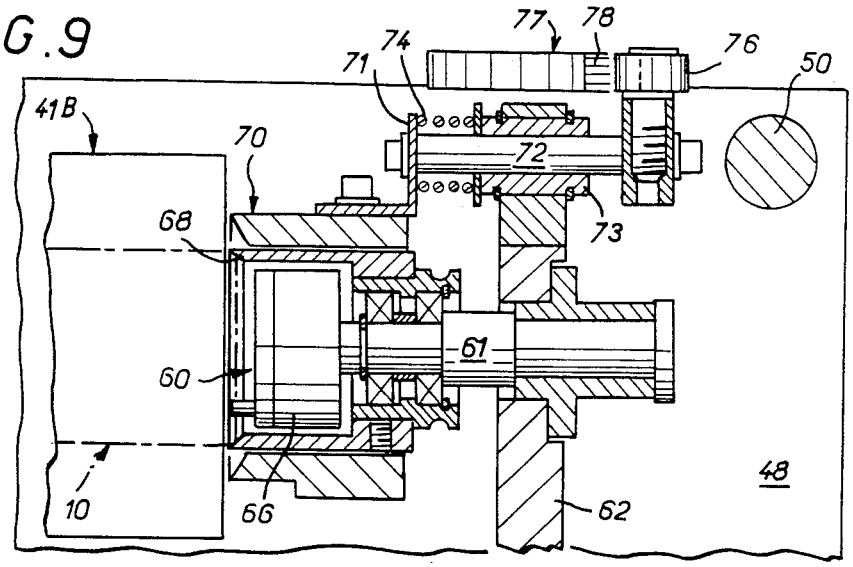

During the corresponding movement of the plate 48 carrying the lower shell 41B, the cam 77 likewise carried by this plate 48 bears with its inclined face 78 on the roller 76, with which the centering sleeve 70 according to the invention is firmly secured, and it thus gradually causes this sleeve to pass from its extended position into its retracted position (FIG. 9).

Simultaneously, the centering fork 80 also carried by the plate 48 comes into engagement with the article-carrier support 17.

This results advantageously in exact positioning of the article-carrier support 17 relative to the shells 41A,41B, any adjustment in position of this article-carrier support 17, which may be necessary for this purpose, being allowed by the shock-absorbing block 32 associated with the slide 25 forming compensating means, this shock-absorbing block 32 then absorbing the corresponding displacement of the relevant section of the conveyor 15.

At the same time, because of the retraction of the centering sleeve 70, the shells 41A,41B can be effectively closed over the bottle 10 to be handled, without interfering with this centering sleeve 70.

Because of the adjustment in position of the article-carrier support 17 by the centering fork 80, on the one hand, and because of the centering of the bottle 10 previously effected by the support block 60, on the other hand, the closing of the shells 41A,41B over this bottle 10 takes place without difficulty.

When the bottle 10 is thus clamped by the shells 41A,41B, its internal volume is pressurized by means of the blast nozzle provided in the usual manner for this purpose in the axis of the core 20 of the article-carrier support 17 on which it is engaged by its neck 12.

In view of the inflating action to which it thus subjected, the wall of the body 11 of the bottle 10 is applied against the corresponding surfaces of the shells 41A,41B, while its bottom 13 abuts against the support block 60.

The imprinting foil 42 is thus pressed against the upper shell 41A, which bears the corresponding stamp with the pattern to be imprinted, the desired imprint thus being ensured.

After this imprinting, the shells 41A,41B are caused to open, the support block 60 is disengagcd from the bottom 13 of the bottle 10 just imprinted and a new cycle can commence, by the upper horizontal section 21 of the conveyor 15 being advanced by one step.

As a result of the transmission means 47 designed to effect reversal of movement according to the invention, the shells 41A,41B return in perfectly synchronous manner in relation to one another, in the course of their movement.

Of course, the present invention is not restricted to the form of embodiment described and illustrated but In particular, it is equally possible for the lower shell to cooperate with the imprinting foil, this lower shell then bearing the corresponding stamp.

Moreover, the shells used have been called upper shell and lower shell in an entirely arbitrary manner for the sake of convenience, in fact the orientation of these shells is not important.

Finally, imprinting stations other than simple presses of gilding type may, if desired, also be operative on the conveyor beyond the gilding-type presses described above, either on a section of this conveyor advancing step by step or on a section thereof advancing continuously.

In this respect, each of the sections may be of any configuration desired.

I claim:

1. A stamping machine having at least one inprinting station of a gilding press type, said stamping machine comprising a frame, two die members mounted for movement in opposite directions on said frame for enclosing at least a portion of an article to be imprinted and applying a foil suitable for the desired impression, control means for controlling the displacement of said die members, said control means comprising a double-acting actuator, said double-acting actuator having a body and a piston rod, said actuator body being mounted on said frame, first means connecting said piston rod to one of said die members and motion reversing means connecting said piston rod to the other of the die members, the motion reversing means including two links pivotally connected to said piston rod at first end of said links and pivotally connected to respective supporting columns at second ends of said links, said supporting columns being fixed at a plate carrying said other die member, and each of said supporting columns being mounted for translatory movement relative to said frame.

2. A stamping machine according to claim 1, further including a conveyor for carrying at least one article carrier support for supporting an article to be imprinted and for conveying said article carrier support at right angles to said imprinting station, said other die member being fixed to a centering fork engageable with a portion of said article carrier support.

3. A stamping machine according to claim 2, wherein said plate carries both said other die member and said centering fork.

4. A stamping machine according to claim 1, said stamping machine being particularly adapted for imprinting an article having a neck, such as a bottle, said stamping machine further including a conveyor carrying at least one article carrier support having a core for engaging a neck of an article, said conveyor having a path of movement running at right angles to said imprinting station, a support block arranged at said imprinting station and mounted for movement transversely in relation to said conveyor for engagement with an end of the article to be imprinted opposite the article neck, a centering sleeve surrounding said support block and mounted for axial movement with respect to said support block between an extended position in which said centering sleeve projects beyond said support block and a retracted position in which said centering sleeve is at most level with said support block.

5. A stamping machine according to claim 4, wherein said centering sleeve is mounted for axial movement against the bias of a return spring constantly urging said centering sleeve toward said extended position, and a follower fixed to said centering sleeve cooperable with a cam fixed for movement with one of said die members.

6. A stamping machine according to claim 4, wherein said centering sleeve is mounted for axial movement against the bias of a return spring constantly urging said centering sleeve toward said extended position, a follower fixed to said centering sleeve cooperable with a cam fixed for movement with one of said die members, and said plate carrying said other die member also carrying said cam for controlling said centering sleeve.

7. A stamping machine according to claim 5, wherein said other die member is fixed to a centering fork for engagement with a portion of said article carrier support, said plate also carrying said cam for controlling said centering sleeve.

8. A stamping machine according to claim 1, wherein said conveyor defines an endless loop running over a plurality of direction change members, motor means for driving at least one of said plurality of direction change means, said conveyor having a first section associated with said imprinting station, means for advancing said first section of said conveyor stepwise, and a second section, said motor means driving said second section of said conveyor through said one of said plurality of direction change mans, two of said direction change means being carried by a common slide for reciprocating movement of said frame, means for controlling said common slide in synchronism with said motor means.

9. A stamping machine comprising a frame and at least one imprinting station of a gilding press type for imprinting an article having a neck, such as a bottle, said imprinting station having two die members mounted for movement in opposite directions and relative to said frame, said die members being adapted to enclose at least a portion of an article to be imprinted for applying a foil suitable for the desired impression, control means for controlling displacement of said die members, said control means acting directly on one of said die members and motion transmission means operatively interposed between said control means and the other of said die members for reversal of movement of said other die member, a conveyor carrying at least one article carrier support including a core engageable with the neck of the article to be imprinted, said conveyor having a path of movement running at right angles to said imprinting station, a support block arranged at said imprinting station mounted for movement transversely in relation to said conveyor for engagement with an end of the article to be imprinted opposite the article neck, a centering sleeve surrounding said support block for axial movement between an extended position in which said centering sleeve projects beyond said support block and a retracted position in which said centering sleeve is at most level with said support block, a return spring constantly urging said centering sleeve toward said extended position, and means for controlling the movement of said centering sleeve comprising a follower fixed for movement with said centering sleeve and cooperable with a cam fixed for movement with one of said die members.

10. A stamping machine according to claim 9, wherein said control means comprises a double-acting actuator, said double-acting actuator having a body and a piston rod, said actuator body being mounted on said frame, said piston rod being connected to said one die member, and said motion transmission means for reversal of movement being connected between said piston rod and said other die member.

11. A stamping machine according to claim 10, wherein said motion transmission means comprises two links, each of said links being pivotally connected to said piston rod at one end and pivotally connected to respective supporting columns at an other end, said supporting columns being fixed to a plate carrying each other die member.

12. A stamping machine according to claim 11, wherein said supporting columns are each received for sliding movement in a sleeve fixed at said frame.

13. A stamping machine according to claim 10, one of said die members being fixed to a centering fork for engagement with a portion of said article carrier support, a plate for carrying said centering fork and said other die member, said plate also carrying said cam for controlling said centering sleeve.

14. A stamping machine according to claim 13, wherein said conveyor defines an endless loop running over a plurality of direction change members, motor means for driving at least one of said plurality of direction change means, said conveyor having a first section associated with said imprinting station, means for advancing said first section of said conveyor stepwise, and a second section, said motor means driving a section of said conveyor through said one of said plurality of direction change means, two of said direction change means being carried by a common slide for reciprocating movement of said frame, and means for controlling said common slide in synchronism with said motor means.

15. A stamping machine according to claim 14, wherein such slide has compensating means coupled to said means for controlling said common slide by a shock absorbing block.

* * * * *